US008579659B2

(12) United States Patent
Tran et al.

(10) Patent No.: US 8,579,659 B2
(45) Date of Patent: Nov. 12, 2013

(54) SMP ELECTRICAL CONNECTOR AND CONNECTOR SYSTEM

(75) Inventors: Hau Tran, Anaheim, CA (US); Mohsin Peeran, West Hills, CA (US); Phil Vaccaro, Merrimack, NH (US)

(73) Assignee: Carlisle Interconnect Technologies, Inc., Saint Augustine, FL (US)

( * ) Notice: Subject to any disclaimer, the term of this patent is extended or adjusted under 35 U.S.C. 154(b) by 56 days.

(21) Appl. No.: 13/419,146

(22) Filed: Mar. 13, 2012

(65) Prior Publication Data

US 2013/0244467 A1 Sep. 19, 2013

(51) Int. Cl.
*H01R 9/05* (2006.01)

(52) U.S. Cl.
USPC ..... 439/578; 439/581

(58) Field of Classification Search
USPC ..... 439/63, 578, 332–335, 581
See application file for complete search history.

(56) References Cited

U.S. PATENT DOCUMENTS

| | | | | |
|---|---|---|---|---|
| 2,540,012 | A | 1/1951 | Salati et al. | |
| 2,984,811 | A | 5/1961 | Hennessey et al. | |
| 3,182,280 | A | 5/1965 | Daut et al. | |
| 3,594,694 | A | 7/1971 | Clark | |
| 4,542,952 | A | 9/1985 | Tomsa | |
| 5,217,391 | A * | 6/1993 | Fisher, Jr. | 439/578 |
| 5,423,692 | A * | 6/1995 | Francis | 439/335 |
| 5,439,386 | A * | 8/1995 | Ellis et al. | 439/322 |
| 5,662,488 | A * | 9/1997 | Alden | 439/314 |
| 6,773,292 | B2 | 8/2004 | Fawcett | |
| 6,808,407 | B1 * | 10/2004 | Cannon | 439/314 |
| 7,347,727 | B2 | 3/2008 | Wlos et al. | |
| 7,354,289 | B2 | 4/2008 | Cannon | |
| 7,601,027 | B2 * | 10/2009 | Rosenberger | 439/578 |
| 7,950,944 | B1 * | 5/2011 | Hertzler | 439/314 |
| 7,972,158 | B2 | 7/2011 | Wild et al. | |
| 8,033,862 | B2 | 10/2011 | Radzik et al. | |
| 8,052,480 | B2 * | 11/2011 | Hauser | 439/672 |
| 8,171,629 | B2 * | 5/2012 | Blew et al. | 29/863 |
| 8,419,468 | B2 * | 4/2013 | Alrutz et al. | 439/578 |
| 2003/0100213 | A1 * | 5/2003 | Yoshigi et al. | 439/372 |
| 2004/0014363 | A1 * | 1/2004 | Khemakhem et al. | 439/620 |
| 2004/0033711 | A1 * | 2/2004 | Loveless et al. | 439/314 |
| 2005/0239311 | A1 * | 10/2005 | Yokoigawa et al. | 439/311 |
| 2006/0046565 | A1 * | 3/2006 | Hosler | 439/578 |

(Continued)

OTHER PUBLICATIONS

Thirteen-page International Search Report and Written Opinion from PCT/US2012/045725 mailed Sep. 24, 2012.

*Primary Examiner* — Ross Gushi
(74) *Attorney, Agent, or Firm* — Wood, Herron & Evans, LLP

(57) ABSTRACT

A push-on connector system includes a male push-on bore including a center conductor pin, and a female push-on core including a socket. The male push-on bore receives the female push-on core. A second bore is configured forwardly of the male push-on bore, and a latch track is positioned in the second bore and forms a plurality of inclined latch surfaces. A movable collar is mounted rearwardly of the female push-on core with a plurality of bayonet pins as is configured for engaging the second bore. The bayonet pins slide along the inclined latch surfaces to axially drive the movable collar into the second bore and secure the female push-on core into the male push-on bore. A resilient member is coupled between the movable collar and female push-on core to bias the female push-on core into the male push-on bore.

27 Claims, 9 Drawing Sheets

(56) References Cited

U.S. PATENT DOCUMENTS

| | | | | |
|---|---|---|---|---|
| 2006/0068623 | A1* | 3/2006 | Purdy | 439/133 |
| 2006/0068634 | A1* | 3/2006 | Petersen et al. | 439/578 |
| 2006/0258180 | A1* | 11/2006 | Kerekes et al. | 439/63 |
| 2008/0014778 | A1* | 1/2008 | Norwood et al. | 439/314 |
| 2008/0113536 | A1* | 5/2008 | Antonini et al. | 439/157 |
| 2008/0254668 | A1* | 10/2008 | Rosenberger | 439/335 |
| 2009/0280685 | A1* | 11/2009 | Gray | 439/607.41 |
| 2010/0124835 | A1* | 5/2010 | Johnson | 439/314 |
| 2010/0176896 | A1* | 7/2010 | Payne | 333/33 |
| 2011/0312199 | A1* | 12/2011 | Alrutz et al. | 439/188 |
| 2013/0029522 | A1* | 1/2013 | Holliday et al. | 439/584 |

* cited by examiner

SMP ELECTRICAL CONNECTOR AND CONNECTOR SYSTEM

FIELD OF THE INVENTION

The present invention relates in general to radio frequency (RF) electrical connectors, and, more particularly, to high frequency RF electrical connectors utilized in rigorous environments.

BACKGROUND OF THE INVENTION

RF electrical connectors are used in the transmission of RF electrical signals to interconnect cables and other components which carry such RF signals. There are a number of different types of cables and components or devices, which carry RF signals such that RF connectors are also used to connect different types of cables and/or devices and components together.

RF connectors generally include one or more jacks and/or one or more interface plugs which are received by the jacks therein and the connectors are formed in a large variety of different configurations for accommodating various interconnecting applications. Generally, each interconnection will include one jack which receives a single mating plug. Such jack and plug elements of a connector are often held together by friction. Some jacks and plugs have threads, which cooperate to secure the pieces together. The cores of the connector components include receptacles to receive matching transmission pins or wires extending within matching connector components.

It is important for RF connector components to be firmly secured to their corresponding interface components to maintain the integrity of the signal passing through the RF connector. A "loose" connection may result in signal loss or unacceptable attenuation. Some systems utilizing conventional RF connectors are subject to vibration during transport or use in harsh environments, which may cause the RF cooperating connectors to become unacceptably de-mated from each other. The peril of a connector loosening or accidentally de-mating as a result of harsh environments is a particular issue with high-bandwidth, sub-miniature "push-on" type connectors.

Push-on connectors are small connectors that are often implemented for high frequency uses, such as signals in the microwave frequency range and up to 40 GHz., for example. The signal integrity of such high frequency RF signals is important, and thus, any coupling or de-mating problems at the push-on connector interface, including any alignment issues with respect to the socket/pin components of an push-on connector are, therefore, particularly important. Generally, such push-on connectors utilize push-on or friction-fit mating, or sometimes snap-on mating to ensure a suitable connection. However, under somewhat vigorous use, and harsh environments that are subject to significant movement or vibration at the connector interface, such conventional push-on architectures may not perform well. Furthermore, there are certain applications where push-on connectors are required to remain mated, even under tensile strain of the cable coupled to the connector.

Accordingly, there is a need to improve upon existing push-on RF connectors. There is further a need to improve upon a push-on connector's ability to resist unintentional de-mating forces, and to maintain signal integrity under adverse operational conditions. These issues and other needs in the prior art are addressed by the invention as described and claimed below.

SUMMARY OF THE INVENTION

A push-on connector system includes a male push-on bore including a center conductor pin coaxially mounted in the push-on bore. A female push-on core includes a socket coaxially mounted with respect to the push-on core and the male push-on bore is configured to receive the female push-on core so the center conductor pin is received in the socket. A second bore is configured and positioned forwardly of the male push-on bore and has a larger diameter than the male push-on bore. A latch track is positioned in the second bore and forms a plurality of inclined latch surfaces ending in respective detents. A movable collar is mounted rearwardly of the female push-on core and includes a plurality of bayonet pins mounted thereon. The movable collar is configured for engaging the second bore when the male push-on bore receives the female push-on core. The collar is rotatable and axially slidable with respect to the female push-on core when engaging the second bore. The bayonet pins slide along the inclined latch surfaces when the collar is rotated to axially drive the movable collar into the second bore and secure the female push-on core into the male push-on bore. The bayonet pins rests in the detents to lock the movable collar in the second bore. A resilient member is coupled between the movable collar and push-on female core and biases the female push-on core into the male push-on bore when the movable collar is axially driven into the second bore.

Figure 1:
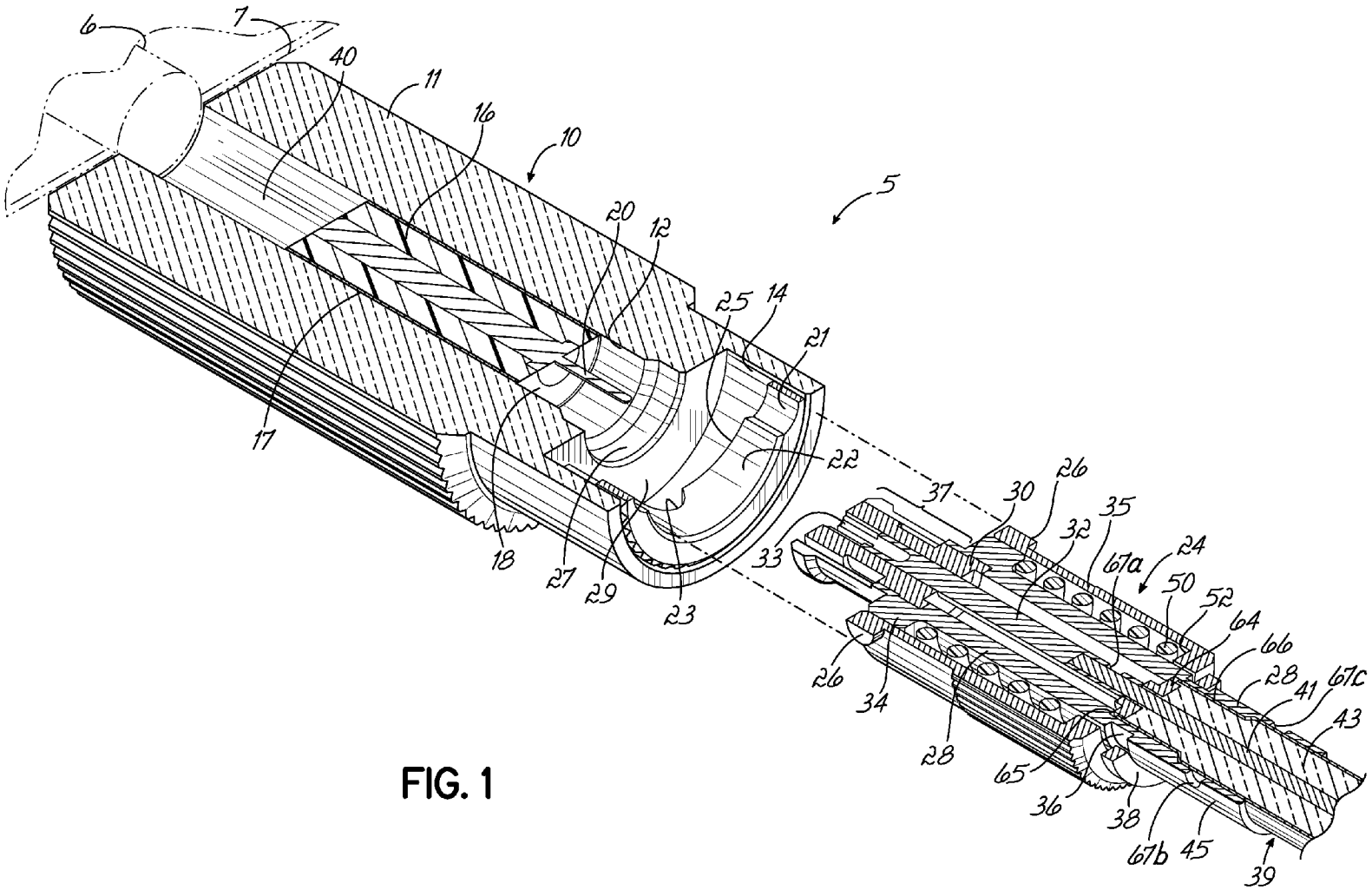
FIG. 1 depicts a perspective cutaway view of the de-mated push-on electrical connector system in accordance with an embodiment of the invention.

It should be understood that the appended drawings are not necessarily to scale, presenting a somewhat simplified representation of various features illustrative of the basic principles of embodiments of the invention. The specific design features of embodiments of the invention as disclosed herein, including, for example, specific dimensions, orientations, locations, and shapes of various illustrated components, as well as specific sequences of operations (e.g., including concurrent and/or sequential operations), will be determined in part by the particular intended application and use environment. Certain features of the illustrated embodiments may have been enlarged or distorted relative to others to facilitate visualization and provide a clear understanding.

DETAILED DESCRIPTION OF EMBODIMENTS OF THE INVENTION

In the following detailed description of the invention, numerous specific details are set forth in order to provide a thorough understanding of the invention. However, it is to be understood that the invention may be practiced without these specific details. In other instances, well known methods, procedures, components, and circuits have not been described in detail so as not to unnecessarily obscure aspects of the invention.

The present invention is directed to a push-on electrical connector system configured to ensure a positive locking interface between internally mounted push-on type SMP RF components. Two connector halves are used with the push-on components. The two connector halves are mated by aligning the bayonet pins of a female connector portion of an push-on connector system with a blind latch track of the male connector portion of the push-on connector system. An axial force is applied until the connector halves are axially seated with respect to each other. A rotational force is then applied until the bayonet pins reach the end of the blind latch track. Releasing the axial application of force allows a resilient member to bias the bayonet pins into cooperating detents in the blind latch track. In addition to providing the bias for the positive locking action in accordance with one feature of the invention, the resilient member contained within the female connector half also ensures that the internal and central push-on RF components remain in constant contact and alignment with each other. Due to the configuration of the inventive system, the male and female portions of the push-on connector are driven toward each other. Therefore, tensile forces and vibration forces might be applied to the connector system and to cables coupled to the connector system, and signal integrity will still be maintained at the connector system interface. Moreover, the push-on RF components maintain a traditional push-on form factor, and ensure robust signal conductivity independent of the locking components. The connector is de-mated using the reverse procedure.

The figures illustrated herein depict one type of push-on connector, namely the Sub Miniature Push-on (SMP) connector. However, as one of ordinary skill in the art will appreciate, the features of the disclosed invention may be readily adapted to other push-on connector form factors. For example, the current invention might be incorporated into push-on connectors sold by Carlisle Interconnect Technologies, the owner of the current Application, as TMP®, SSMP®, WMP® connectors, and other similar electrical connectors.

FIG. 1 depicts a perspective cutaway view of the de-mated push-on electrical connector system 5 of an embodiment of the invention. The male connector portion 10 includes a body 11 preferably formed of a suitable metal, such as brass. The body 11 includes a pair of concentric bores of different diameters formed internally therein. The bores may be appropriately mechanically formed in the body 11. A bore for a mating female push-on portion is formed by a first bore 12. A second bore 14 of larger diameter than the first bore 12 is positioned forward of the bore 12. The first bore 12 forms the bore for housing the pin 20 of the male portion of the push-on connector assembly. Accordingly, for consistency herein, the terms "male" and "female" are utilized with reference to the push-on connector assembly gender naming convention. Thus, the connector portions 10, 24 of the connector system that provide the robust locking and securement features of the inventive system are also referenced with respect to the push-on form factor. Therefore, the connector portion 10 housing the male portion (bore 12, pin 20) of the push-on connector assembly is referred to as male connector portion 10, while connector portion 24 is referred to as female connector portion 24, as it houses the female portion (core element 28, receptacle 32) of the push-on connector assembly.

The second bore 14 terminates generally flush with the forward end of the male connector portion 10, while the first bore 12 is nested coaxially and more deeply within the male connector portion 10. As noted below, bore 12 incorporates a series of tapered transition surfaces 27 separating the bores 12, 14. A dielectric cylinder 16 having a dielectric face 18 is tightly mated within the first bore 12. The dielectric face 18 forms a mating surface at the bottom of the first bore 12. A male center conductor pin 20 is mated coaxial to the dielectric cylinder 16, and the end of center conductor pin 20 extends a suitable distance past the dielectric face 18 into the first bore 12. An outer conductor 17 surrounds the dielectric cylinder 16, and provides a complete coaxial relationship with center conductor pin 20. The push-on ferrule core 37 engages the pin 20 and conductor 17, when the portions 10, 24 are locked together. To provide the requisite degree of resilient contact, the push-on core 37 may be formed from Beryllium Copper or some other suitable conductor. The male portion 10 may be appropriately coupled with coaxial conductors of a cable 6 to terminate the cable 6, or might be coupled with a circuit board 7 or other backplane connector arrangement.

A blind latch track 22 is implemented in male connector portion 10 for securing male portion 10 with female portion 24. The blind latch track is internal to portion 10 inside bore 14. In one embodiment of the invention, the latch track 22 is formed as a bayonet-style latch track having one or more grooves 21 formed therein for receiving one or more bayonet pins 26. Latch track 22 incorporates one or more inclined track surfaces 25 that incline in a generally spiral fashion around the inside of bore 14. The inclined track surfaces 25 are inclined to spiral inwardly toward the direction of pin 20 from the front end of portion 10. The latch track 22 might be formed in a number of different ways within connector portion 10.

In the illustrated embodiment, track 22 is formed as a sub-assembly that is permanently press-fit into the second bore 14. Alternatively, the latch track 22 might be machined inside portion 10. In the illustrated embodiment, the blind latch track 22 forms a cylinder with a plurality of spiral track surfaces 25 therein, that can interface with a plurality of cooperating pins 26 located on the opposite or female connector portion 24. The spiral track surfaces 25 of the blind latch track 22 each terminate in a respective detent 23 which provides positive mechanical retention when mated with cooperating pins 26 that slide into the detents 23. Once the blind bayonet latch track 22 sub-assembly has been pressed into or otherwise formed in the second bore 14, its outer face may be substantially flush with the front end of the male connector portion 10 and it is generally prevented from rotating or axially displacing with respect to the male connector portion 10. Moreover, the profile of the blind latch track 22 is concealed from the exterior of the connector, and does not penetrate the exterior or the end face of the male connector portion 10.

As may be appreciated, the latch track 22 will form suitable inclined track surfaces 25 to guide each of the respective bayonet pins 26 that are implemented in the female portion 24 of the connector. In the illustrated embodiment of the invention, two bayonet pins 26 are generally positioned at 180 degrees in opposing positions on the outer surface of female connector portion 24. As such, the latch track 22 forms two inclined track surfaces 25, with respective grooves 21 and detents 23, for receiving, guiding, and capturing the bayonet pins 26. However, the connector is not limited to only two pins, and a greater or lesser number of pins might be utilized for the invention. As may be appreciated, the length of the inclined track surfaces 25 will be configured based on the number of pins 26 and their positioning around the female connector portion. The positioning of the detents 23, with respect to the grooves 21, will determine how much rotation of the female connector portion elements (e.g., rotating collar 35) are necessary for the pins 26 to follow the surfaces 25 and seat in the respective detents. In one embodiment as illustrated, the detents 23 are located approximately 45 degrees from a respective receiving groove 21. Therefore, the surfaces 25 span approximately 45 degrees around the inside of bore 14, and a quarter of a turn of the rotating collar 35 of female portion 24 is necessary to provide the locking of the connector system in accordance with the invention.

As illustrated in FIG. 1, for suitable mating of the female core element 28 and male bore 12 and the respective push-on connector components, the bore 12 may incorporate a series of tapered end surfaces 27. The surfaces guide part of core element 28 into bore 12, and align pin 20 with a suitable female socket 33 of the female push-on connector portion. The difference in diameter between bore 12 and bore 14 creates an internal stop surface 29 in bore 14 to provide an insertion stop when female connector portion 24 engages male connector portion 10. Transition surfaces 27 transition inwardly from an inner diameter of the stop surface 29 to the mixer diameter of the bore 12 for receiving and guiding the core 37 of core element 28 into bore 12 for proper mating and alignment of the two push-on connector portions. While the illustrated embodiment incorporates three transition surfaces into the bore 12, a greater or lesser number of such transition surfaces 27 might be implemented as appropriate for capturing and guiding the core 37 of element 28 of the female portion 24 of the push-on connector.

Turning now to the female connector portion 24, it includes a core element 28, and a sliding and rotating, movable collar 35 that slides axially and rotates on the outside of the core element 28. The core element 28 forms a core portion or push-on core 37 at the forward end of portion 24. The collar 35 is mounted rearwardly of the push-on core 37. The female push-on core 37 is received into bore 12. The exterior diameter of the female connector portion 24 is configured and sized to interface, utilizing a clearance-type fit, with the inside diameter of the blind latch tracks 22. A plurality of bayonet pins 26, extending outwardly from an outside surface of the female connector portion 24, and particularly on an outside surface of the collar 35, are configured to cooperate with the blind latch tracks 22. The bayonet pins illustrated on the outside of collar 35 must be aligned with appropriate grooves 21 formed in latch track 22. The push-on core 37 at one end of core element 28 is cross sectioned and configured to fit tightly within the first bore 12 for a suitable push-on connector arrangement. The other end of the core element may be configured to receive an RF cable or otherwise connect to an RF circuit. Similar to a conventional push-on female core, core 37 may include a flared end and one or more slots 31 formed therein in the core wall to provide flexible sections of the core 37 that may flex and provide a friction fit inside bore 12 (See FIGS. 2 and 3). Inwardly coaxial to the push-on core 37 is a dielectric cylinder 30 which electrically isolates a coaxial female socket 33 of a center receptacle 32 from the wall of the push-on core 37. The female core 37, dielectric cylinder, and socket 33 form the female portion of the push-on connector. The center receptacle 32 may be configured to terminate at one end substantially flush with the end of the second dielectric cylinder 30 and mate with the center conductor pin 20 through insertion of pin 20 into socket 33. The remaining portion of the core element 28 extends rearwardly from the core 37, such as to engage the center conductor 41 of a cable 39.

The core element 28 of the female connector portion 24 includes a flange 34 that extends around an outside surface of the core element, and is positioned coaxially around the outside of core element 28. The flange 34 is located inside of moveable collar 35. The flange 34 is configured to have an exterior diameter slightly smaller than the inside diameter of the movable collar 35 so the collar may freely move with respect to the flange. When assembled, the center receptacle 32, dielectric cylinder 30, core element 28, and the resilient member flange 34 are all fixed and immoveable with respect to each other. For example, the dielectric cylinder 30 and receptacle 32 might be press fit into the end of the core element 28 proximate to core 37 and member flange 34. The core element 28 could then be coupled to a coaxial cable 39 for example. The collar 35 slides and rotates on the outside of the flange 34 and core element 28. As discussed further herein below, an element or resilient member 50, is operably captured or coupled between the core element 28 and the movable collar 35. In one embodiment of the invention, the resilient member 50 is a spring in the form of a coiled spring 50 that surrounds the outside of the core element 28. As would be readily apparent to one of ordinary skill in the art, spring 50 may be replaced with some other suitable element, such as a urethane structure, gas filled bellows, or other appropriate biasing element or medium to provide the necessary biasing forces for the collar 35.

The movable collar 35 then slides on the outside of core element 28. Spring 50 is coupled or captured between the two elements 28, 35 to resiliently bias the elements with respect to each other. A retaining groove 36 formed in core element 28, and cooperating retaining clip 38 can serve to retain the movable collar 35 around core element 28 from the rear of the connector portion 24.

As noted in the illustrated embodiment, the spring 50 is selected to be a coil-type design. The coil-type design provides for a greater amount of axial movement and force for the sliding collar 35 and overall connector system. The greater axial displacement and force, results in a locking connector that does not become progressively looser fitting after repeated coupling and decoupling, as may occur with other spring elements, such as wave washer elements. Additionally, the greater axial displacement of a coil-type spring, provides for a greater flexibility in configuring the geometries of the blind latch track 22. The steepness of the inclines of the generally spiral track surfaces 25 can be increased or decreased to manipulate the rotational force required to couple and decouple the connector pair. Additionally, modification of the steepness of the track surfaces will result in a higher or lower degree of force biasing the push-on core 37 into the first bore 12, in the mated configuration. Accordingly, the present invention offers significant adjustable features to ensure a robust connection and desirable signal qualities.

The connector system of the invention may be utilized with a coaxial cable, as illustrated in the drawings, or might be implemented with an RF circuit board. For example, male connector portion 10 might include a cable bore 40, which receives a coaxial cable 6 that is appropriately connected with pin 20 and an outer conductor 17 for forming an electrical circuit. Alternatively, a portion of the connector system might be directly coupled to a circuit board or backplane surface, such as by soldering or otherwise securing male connector portion 10 to an RF circuit board. Female connector portion 24 is shown appropriately coupled with the coaxial cable, including a center conductor 41 and surrounding insulator 43. Center conductor 41 is electrically connected, such as by soldering, with an end of the receptacle 32 opposite socket 33. Center conductor 41 may be efficiently soldered to the end of the receptacle 32 by utilizing one or more soldering ports 67*a* formed in the receptacle 32. Flange 34 includes a collar portion 45 that engages the outer insulator 43 of cable 39. An outer conductor, or outer shielding 66 of cable 39 is electrically coupled to core element 28.

Figure 9:
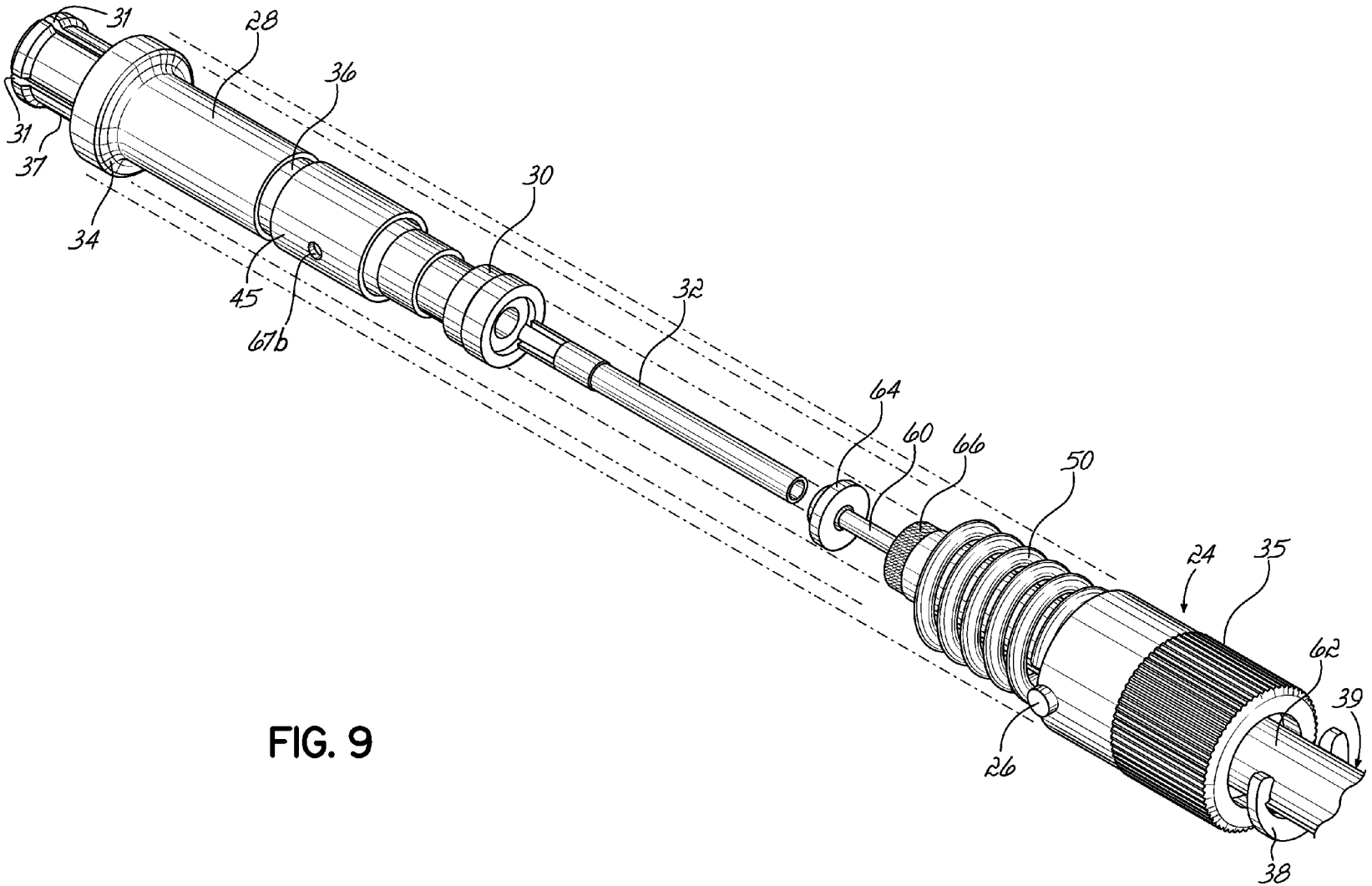
FIG. 9 is an exploded view of the female portion of the push-on connector system.

FIG. 9 is an exploded view of the female connector portion 24. The core element 28 receives the dielectric cylinder 30 and center receptacle 32 in proper alignment and in a press fit. The center conductor 41 of a coaxial cable 39 is soldered to an end of receptacle 32, and is surrounded by, and protected by, an isolation disk 64 formed of a suitable insulative or dielectric material. Disk 64 engages a shelf 65 formed in one end of the core element (See FIGS. 1 and 9). The outer shielding 66 of cable 39 is soldered to the core element 28 or collar portion 45 by utilizing one or more soldering ports 67*b* and 67*c*. The spring 50 and collar 35 are mounted coaxially on the outside of the core element 28, and are secured by placing the retaining clip 38 into the retaining groove 36.

The spring 50, nested within the void formed between the movable collar and the core element 28, is retained at its ends between flange 34 on core element 28 and a shelf 52 formed on the inside surface of collar 35. The shelf 52 forms a circumferential annular face at one end of the collar 35 opposite the flange 34. The shelf 52 extends radially inwardly on collar 35, while flange 34 extends radially outwardly. The inside diameter of the shelf 52 is configured to be slightly larger than the largest outside diameter of the core element 28. The dimensional clearance between the outside diameter of the flange 34 and the inside diameter of the collar 35, and the dimensional clearance between the outside diameter of the core element 28, and the inside diameter of the shelf 52, allow the movable collar 35 to readily slide axially and rotate with respect to the core element 28 while remaining generally concentric thereto, and containing the spring 50 therebetween.

Figure 2:
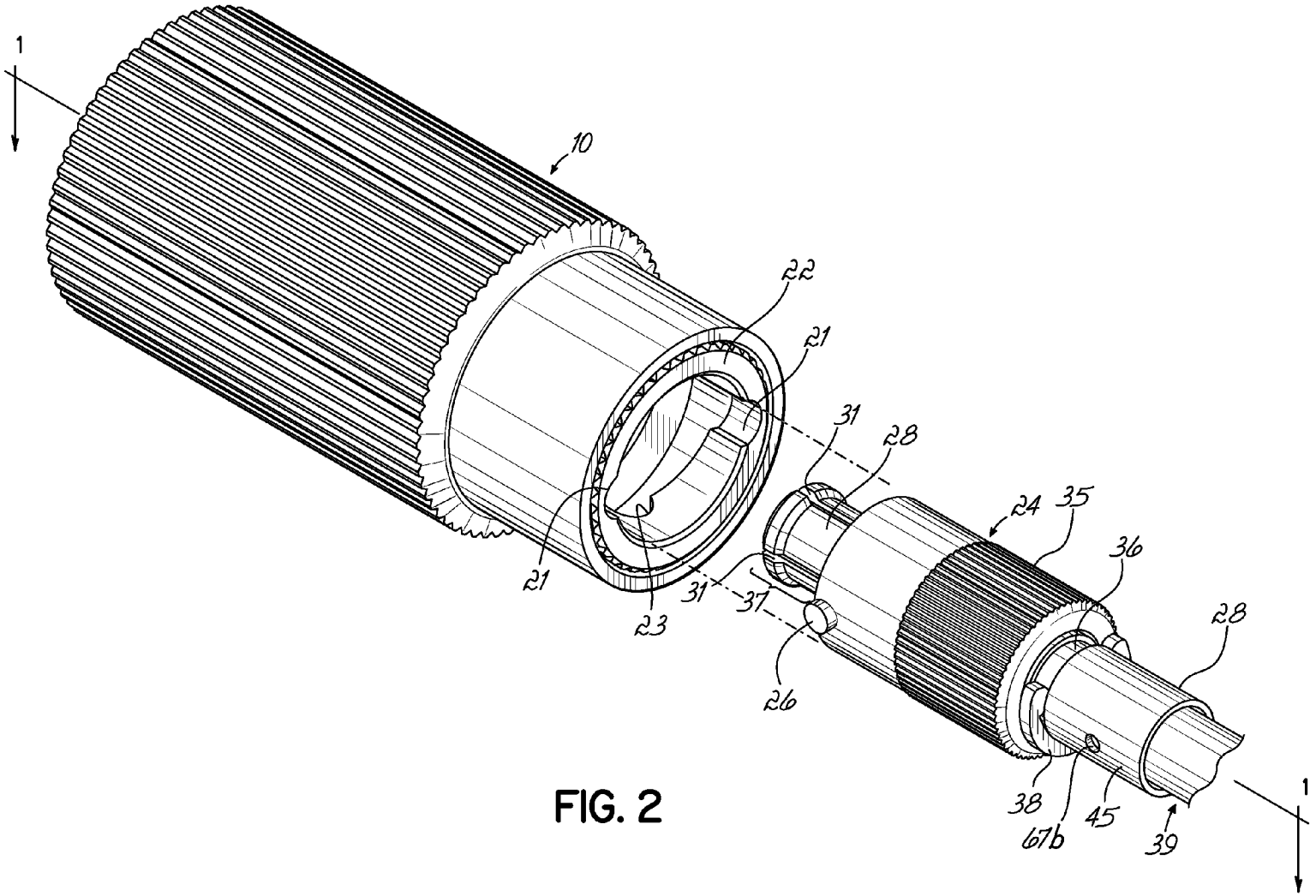
FIG. 2 shows a solid-form perspective view of the de-mated locking connector system in accordance with an embodiment of the invention.

FIG. 2 shows a solid-form perspective view of the demated portions of the connector system. The male connector portion 10 and female connector portion 24 are shown appropriately aligned for mating. The collar 35 is rotated so the bayonet pins 26 are aligned with the grooves 21 in the blind latch track 22, and the two structures will cooperate once an axial force begins to seat female connector portion 24 into male connector portion 10. As one skilled in the art will readily appreciate, since the movable collar 35 and its integrated bayonet pins 26 are spring biased, the collar 35 is biased rearward against the retaining clip 38 that is mounted in the retaining groove 36 of core element 28. The collar 35 is free to rotate independently of the push-on core element 28 and core 37 to facilitate appropriate alignment between the bayonet pins 26 and the blind latch track 22.

Figure 3:
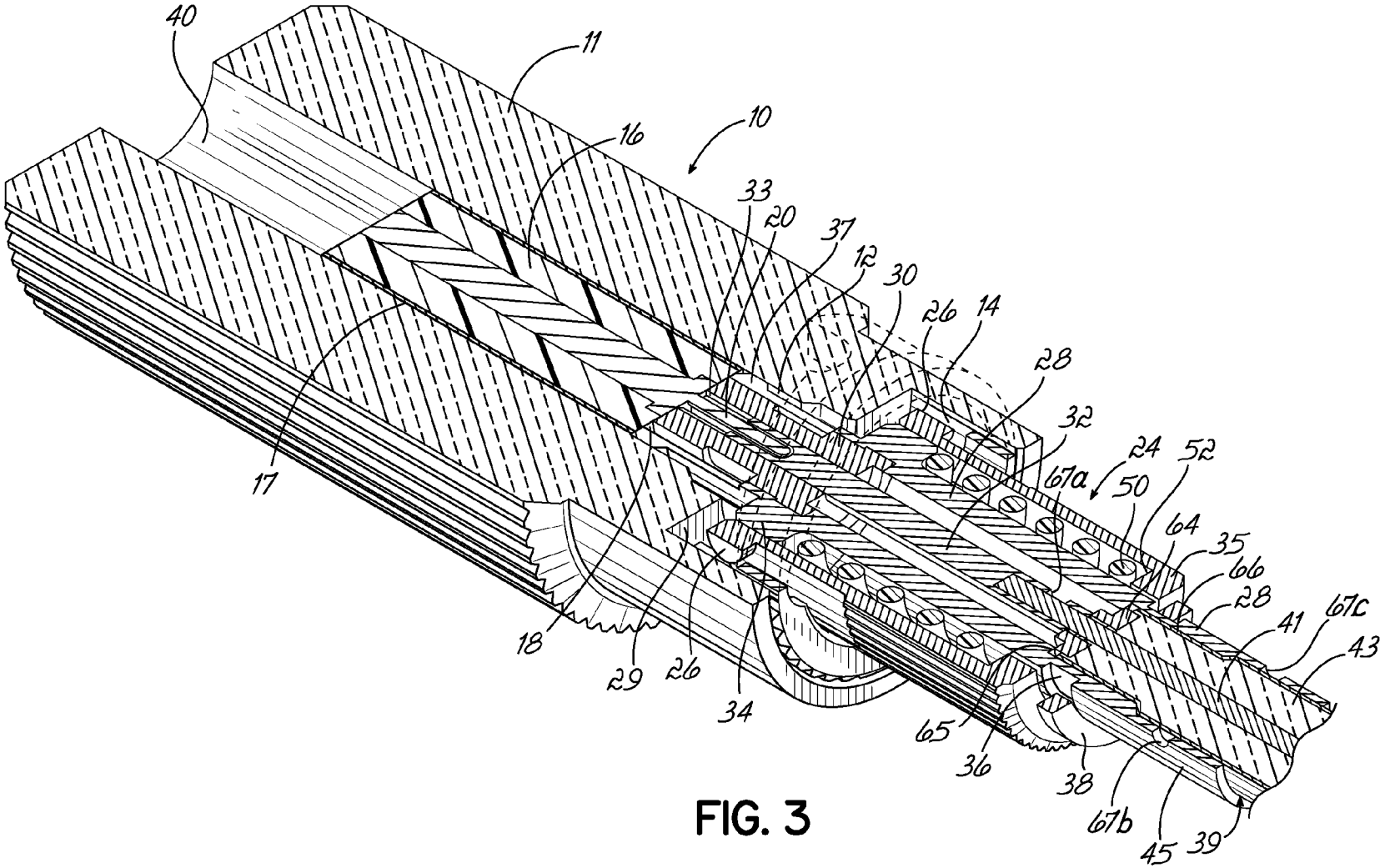
FIG. 3 depicts a perspective cutaway view of the mated push-on connector system in accordance with an embodiment of the invention.

FIG. 3 depicts a perspective cutaway of mated connector portions 10, 24, wherein portion 24 has been seated, but not significantly rotated into a locked configuration. In this view, a user applies an axial force to the collar 35 and female connector portion 24, partially seating the core element 28 and core 37 and collar 35 within the male connector portion 10. The core 37 is pushed into bore 12 for a friction fit. The female connector portion 24 may be considered to be only "partially" seated because the collar 35 will eventually be driven more deeply into the male connector portion, as it follows the spiral and inclined surfaces of the blind latch tracks 22 during rotational locking. In this figure, the electrical components of the push-on connector elements (core 37, bore 12, pin 20, socket 33) are properly mated, even though the connector system is not in a locked configuration. The push-on core 37 is fully seated into the inner bore 12, and has bottomed out against the dielectric face 18. Similarly, the center conductor pin 20 is fully seated within the center female socket 33 of receptacle 32. Core 37 electronically couples with outer conductor 17 in the male connector portion 10. The connector maintains full signal integrity in the seated, but unlocked, configuration, as the push-on components are friction fit in the conventional push-on connector fashion.

Figure 4:
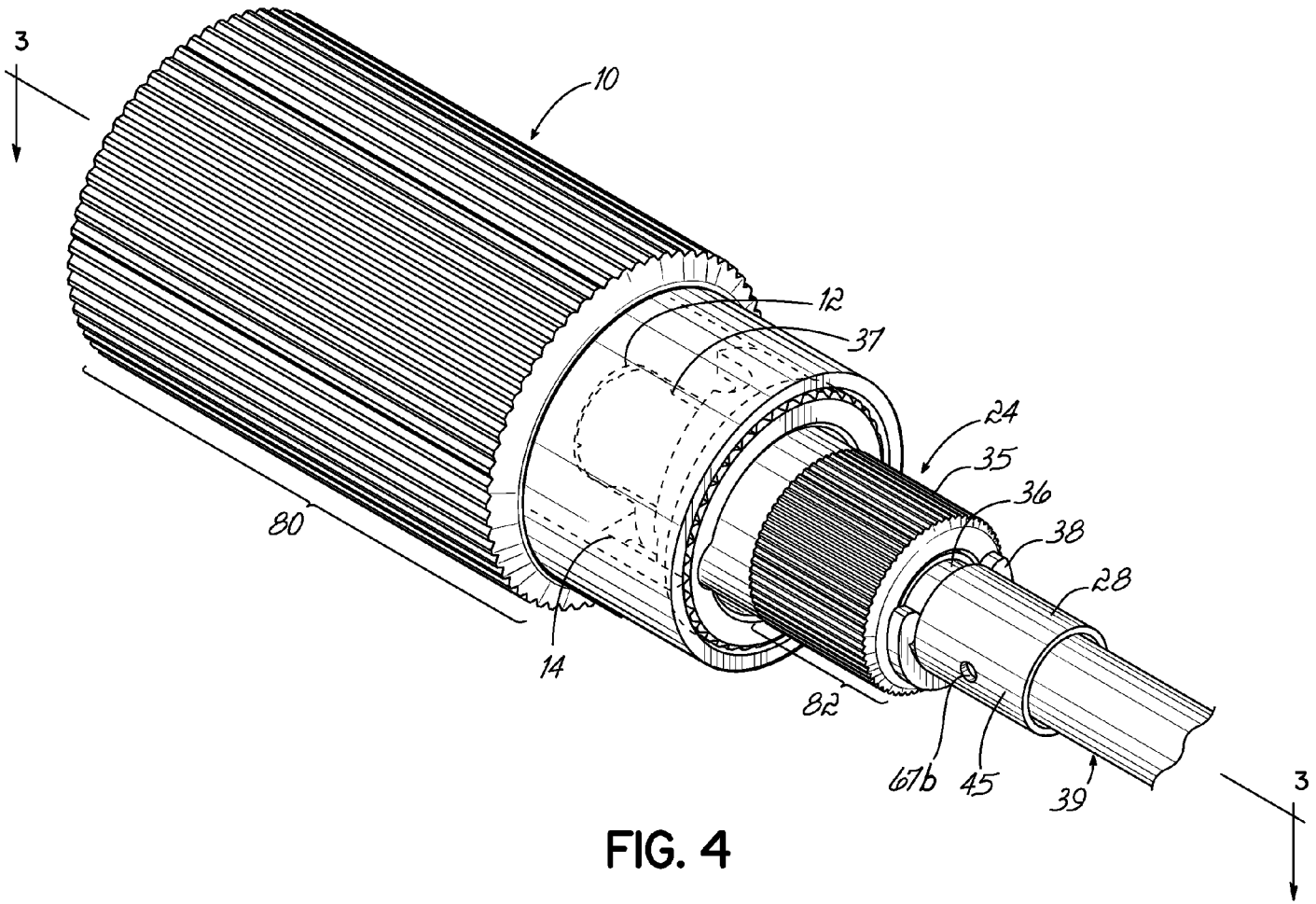
FIG. 4 is a perspective view of the mated push-on connector system of FIG. 3.

The spring 50 is generally in the same configuration as depicted in FIG. 1 and FIG. 2. The spring 50 has not been significantly compressed, and the movable collar is still free to travel axially more deeply within the male connector portion 10. The two portions 10, 24, seated together as shown, are ready for further engagement by rotating collar 35 and driving the collar deeper into bore 14. FIG. 4 is a perspective view of the seated connecter portion showing collar 35 inserted into bore 14.

Figure 5:
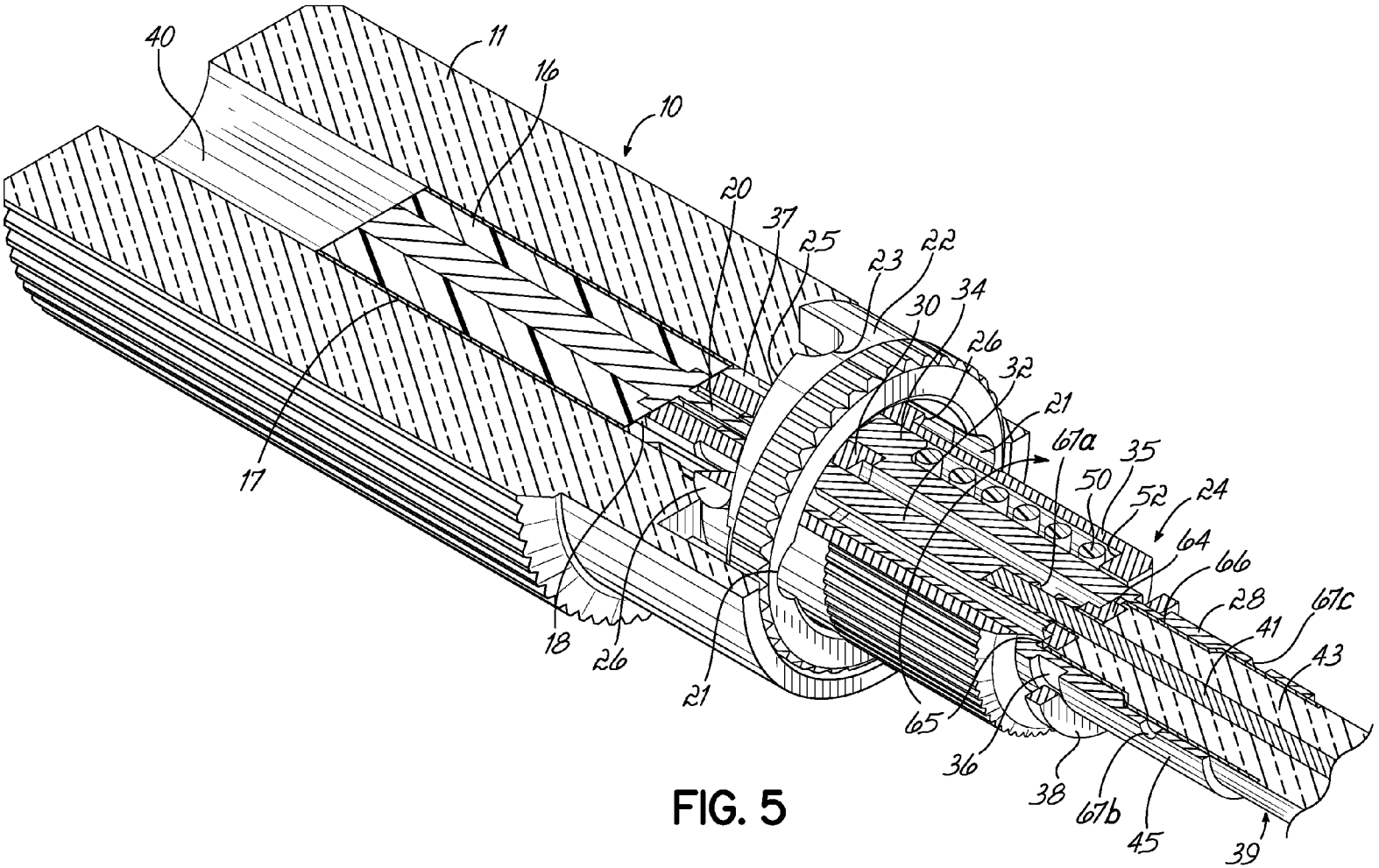
FIG. 5 is a perspective cutaway view of the push-on connector system in a partially locked configuration.

FIG. 5 is a perspective cutaway view of the connector system in a partially locked configuration. A user rotates the movable collar 35 of female connector portion 24 with respect to the fixed male connector portion 10. Each of the portions 10, 24 might include appropriate knurled sections 80, 82, as seen in FIG. 4, for assisting in the manipulation of the portions 10, 24, and rotation with respect to each other. In addition to the fully seated push-on electrical components of FIG. 4 (push-on core element 28, bore 12, dielectric face 18, center conductor pin 20 and socket 33), the bayonet pins 26 have started to engage the spiral inclined surfaces 25 of the blind latch tracks 22. As noted, the illustrated embodiment uses two bayonet pins 26 and thus, has two latch tracks 22. Since the push-on core element 28 was already fully seated in bore 12, this inclined surface engagement serves to pull the bayonet pins 26 and accompanying collar 35 forward and more deeply into the bore 14 of the male connector portion 10. As rotation continues to drive the bayonet pins 26 along the inwardly inclined surface 25 of the blind latch track 22, the spring 50 is increasingly compressed by movement of shelf 52 toward flange 34. The spring thus, is compressed to act against flange 34 and core element 28, driving core element 28 further into bore 14. This spring bias simultaneously forces the push-on core 37 against the dielectric face 18, while the collar 35 and bayonet pins 26 are forced against, and sliding along, the inclined surfaces 25 of the blind latch track 22. As may be seen, the incline of surfaces 25 is in the axial direction, toward the bore 12 and surface 18. Since the spring 50 is under compression in this figure, there is a perceptible gap between the end of collar 35 and the retaining clip 38 that is mounted in the retaining groove 36.

Figure 6:
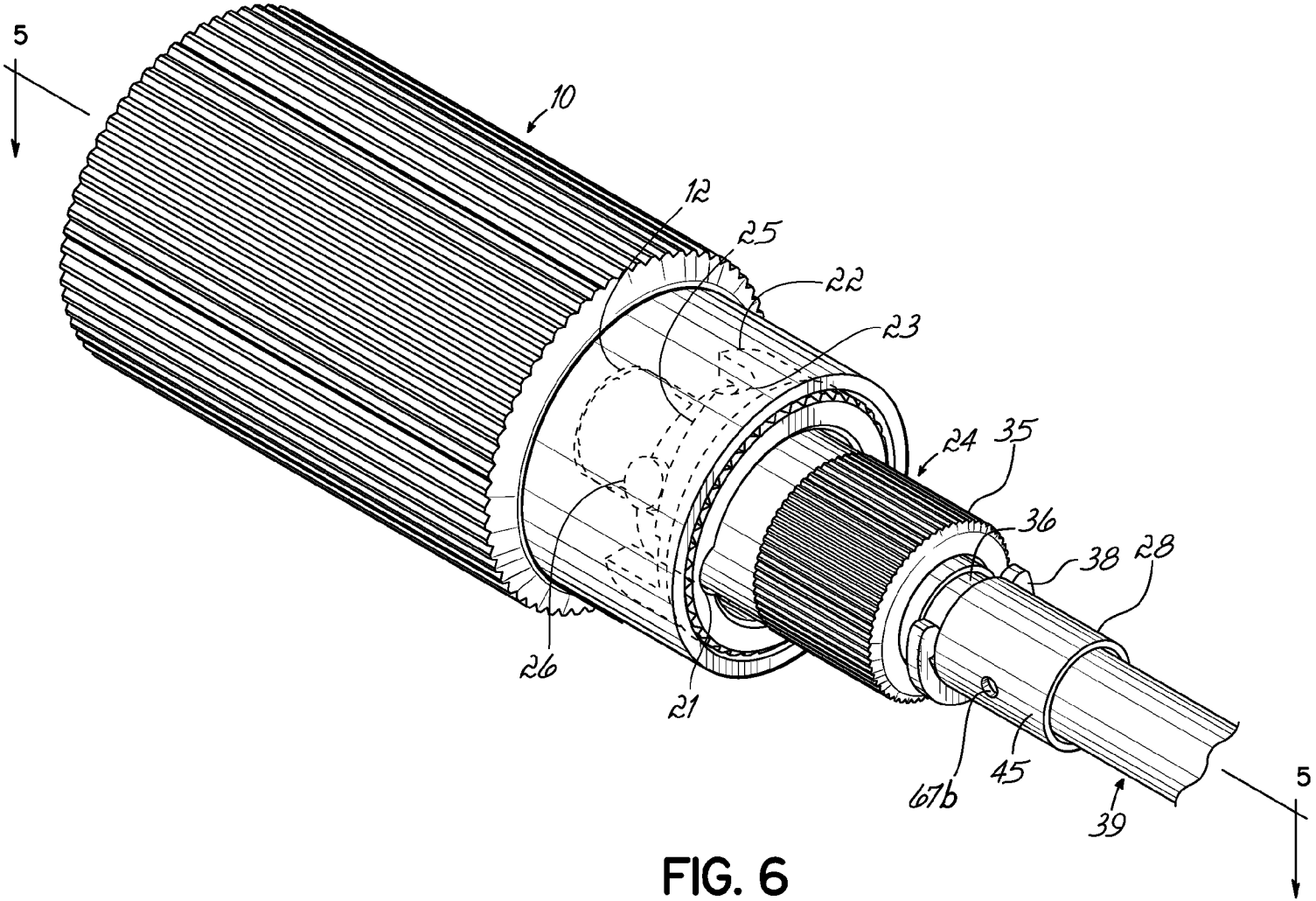
FIG. 6 is a perspective view of the push-on connector system in a partially locked configuration.

FIG. 6 is a perspective view of the partially locked connector system. The user's rotation of the collar 35 and bayonet pins 26, has caused the bayonet pins 26 to travel along the inclined surfaces 25 of the blind latch track 22. The bayonet pins 26 have not yet reached the final locked position, which terminates in detents 23.

Figure 7:
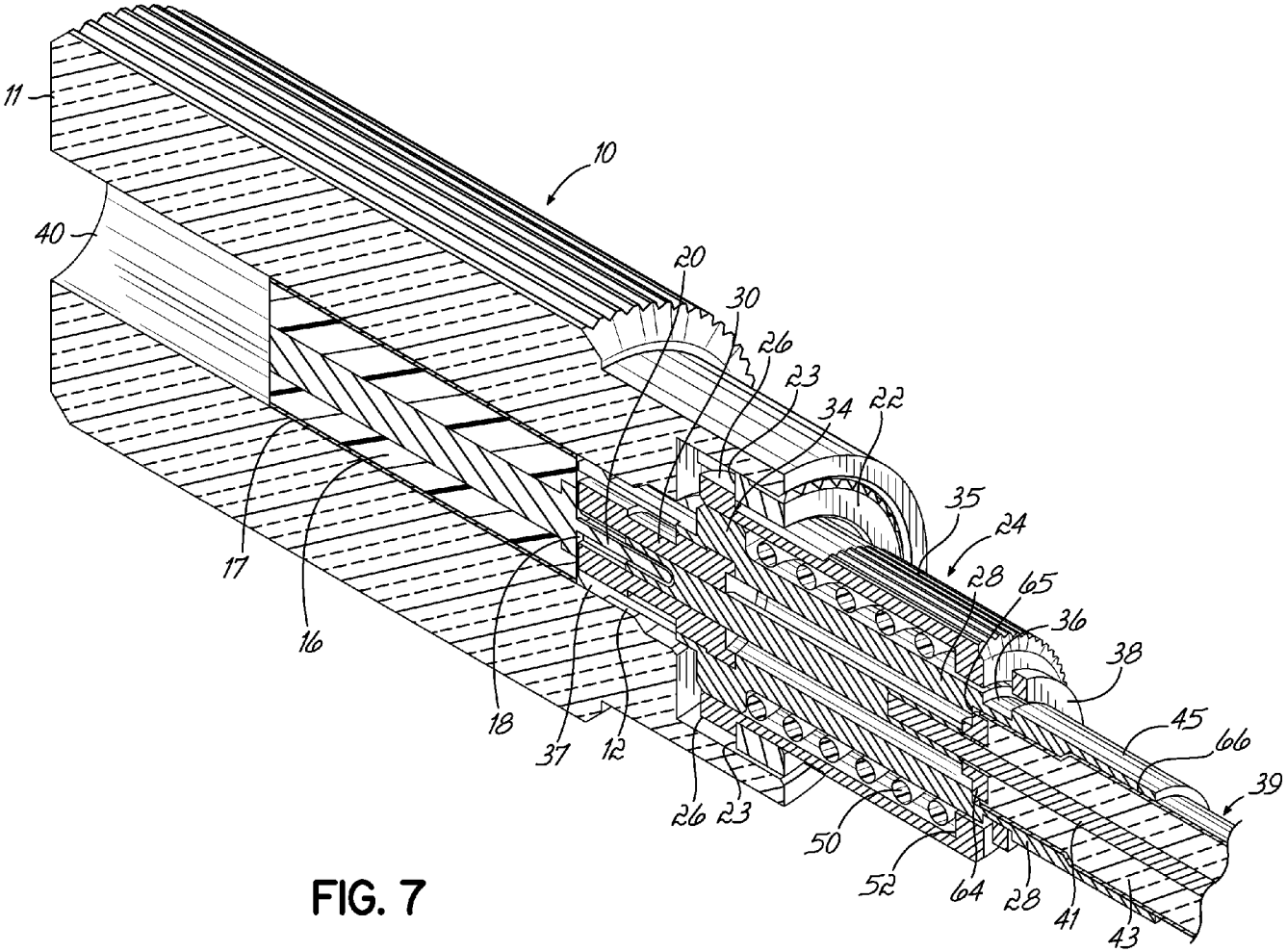
FIG. 7 shows a perspective cutaway view of the mated and locked push-on connector system.

FIG. 7 shows a perspective cutaway view of the mated and locked connector system. The bayonet pins 26 have reached the end of the inclined surface 25 of blind latch tracks 22, and are seated under spring bias within the detents 23. Likewise, the push-on core 37 is fully seated within the first bore 12, and the push-on core 37 is under forward axial bias against the dielectric face 18 as a result of the compressed spring 50 driving core element 28.

Since the connector pair utilizes components with conventional push-on dimensions, it should be noted that backward-compatibility is available. Locking genders may be mated with non-locking opposite gender push-on connectors, and the inventive connector would operate as a conventional push-on connector, only with a friction fit. The locking functionality will be lost.

When the axially displaced female connector portion 24 compresses the spring 50, the cooperating retaining groove 36 and retaining clip 38 are not necessary to maintain the locking action of the connector pair. Additionally, the retaining clip 38 may be removed from a mated connector pair to allow the bayonet pins 26, spring 50, and blind bayonet latch track 22 to by be axially decoupled and inspected without decoupling the push-on core 37 from the first bore 12. Once the retaining clip 38 is removed, a user can apply a light axial force to ensure that the push-on core 37 remains seated. While applying that force, the collar 35 can be rotated and axially withdrawn from the second bore 14 to facilitate inspection of the components. In some embodiments of the invention, the internal push-on connector components may be electrically insulated from the collar 35 and connector portion 24 and the male connector portion 10. By providing such electrical insulation, high frequency RF signals carried by the internal push-on components (first bore 12 and push-on core 37) may be unaffected by unintended contact between the locking portion components (male connector portion, 10 female connector portion 24) and stray electrical sources. It should be noted, in all embodiments, that electrical contact between locking components is not essential to maintaining the signal integrity of the mated connector pair.

Figure 8:
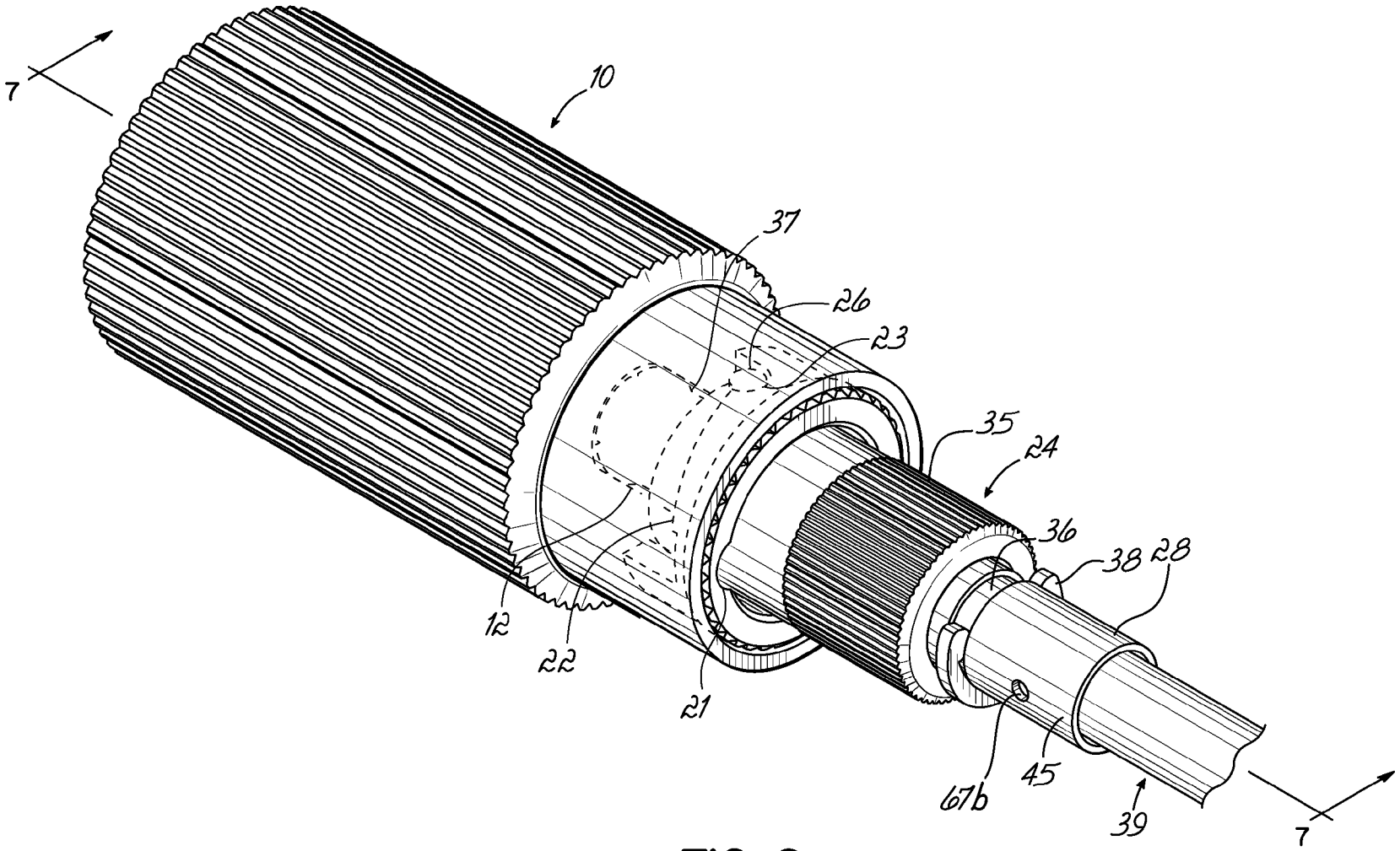
FIG. 8 is a perspective view of the mated and locked push-on connector system.

FIG. 8 is a perspective view of the mated and locked connector system. The push-on core 37 is fully seated within the first bore 12, and the push-on core 37 is under forward axial bias against the dielectric face 18 as a result of the compressed spring 50. The bayonet pins 26 have reached the end of the blind bayonet latch tracks 22, and are seated under spring bias within the respective detents 23.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of representative apparatus and method, and illustrative examples shown and described. Accordingly, departures may be made from such details without departure from the spirit or scope of applicant's general inventive concept.

What is claimed is:

1. A push-on connector system, comprising:

a male push-on bore including a center conductor pin coaxially mounted in the push-on bore;

a female push-on core including a socket coaxially mounted with respect to the push-on core;

the male push-on bore configured to receive the female push-on core so the center conductor pin is received in the socket;

a second bore configured forwardly of the male push-on bore, said second bore being of a larger diameter than the male push-on bore;

a latch track positioned in the second bore and forming a plurality of inclined latch surfaces ending in respective detents;

a movable collar mounted rearwardly of the female push-on core and including a plurality of bayonet pins mounted thereon, the movable collar configured for engaging the second bore when the male push-on bore receives the female push-on core and being rotatable and axially slidable with respect to the female push-on core when engaging the second bore;

the bayonet pins sliding along the inclined latch surfaces when the collar is rotated to axially drive the movable collar into the second bore and secure the female push-on core into the male push-on bore, the bayonet pins resting in the detents to lock the movable collar in the second bore;

a resilient member coupled between the movable collar and female push-on core, the resilient member biasing the female push-on core into the male push-on bore when the movable collar is axially driven into the second bore.

2. The push-on connector of claim 1 further comprising grooves formed in the latch track for receiving the bayonet pins when the movable collar engages the second bore.

3. The push-on connector of claim 1, wherein the latch track is positioned in the second bore to form a blind latch track.

4. The push-on connector of claim 3, wherein the latch track is press-fit into a non-rotatable orientation into the second bore.

5. The push-on connector of claim 1, wherein an outer diameter of the movable collar is configured to nest tightly within an inside dimension of said latch track.

6. The push-on connector of claim 1, wherein the resilient member is a coil spring.

7. The push-on connector of claim 1 further comprising a core element including the female push-on core, the core element including a flange thereon, the movable collar including a shelf, the resilient member captured between the movable collar shelf and core element flange for biasing the core element and female push-on core when the movable collar is axially driven into the second bore.

8. The push-on connector of claim 1 further comprising a core element including the female push-on core, the movable collar being rotatable and axially slidable with respect to the core element, a retaining groove formed in an outer surface of the core element and a retaining clip positioned in the groove and containing the movable collar on the core element.

9. The push-on connector of claim 1, wherein the female push-on core and male push-on bore form an electrical path that is independent of an interface between the movable collar and second bore.

10. A signal connection system, comprising:

a first coaxial cable having an inner conductor and outer conductor;

a male connector portion terminating the first coaxial cable, the male connector portion including:

a push-on bore including a center conductor pin coaxially mounted in the push-on bore, the center conductor pin coupled with the inner conductor of the first coaxial cable;

a second bore configured forwardly of the push-on bore, said second bore being of a larger diameter than the push-on bore;

a latch track positioned in the second bore and forming a plurality of inclined latch surfaces ending in respective detents;

a second coaxial cable having an inner and outer conductor;

a female connector portion terminating the second coaxial cable, a female connector portion including:

push-on core including a socket coaxially mounted with respect to the push-on core, the socket coupled with the inner conductor of the second coaxial cable;

the push-on bore configured to receive the push-on core so the center conductor pin is received in the socket;

a movable collar mounted rearwardly of the push-on core and including a plurality of bayonet pins mounted thereon, the movable collar configured for engaging the second bore when the push-on bore receives the push-on core and being rotatable and axially slidable with respect to the push-on core when engaging the second bore;

the bayonet pins sliding along the inclined latch surfaces when the collar is rotated to axially drive the movable collar into the second bore and secure the female push-on core into the male push-on bore, the bayonet pins resting in the detents to lock the movable collar in the second bore;

a resilient member coupled between the movable collar and push-on core, the resilient member biasing the push-on core into the push-on bore when the movable collar is axially driven into the second bore.

11. The signal connection system of claim 10, wherein the said second bore has a larger diameter than the male push-on bore.

12. The signal connection system of claim 10, wherein the latch track is positioned in the second bore to form blind latch tracks.

13. The signal connection system of claim 10, wherein the resilient member is a coil spring.

14. The signal connection system of claim 10, wherein the female connector portion further includes a core element including the push-on core, the core element including a flange thereon, the movable collar including a shelf, the resilient member captured between the movable collar shelf and core element flange for biasing the core element and push-on core when the movable collar is axially driven into the second bore.

15. The signal connection system of claim 10, wherein the female connector portion further includes a core element including the push-on core, the movable collar being rotatable and axially slidable with respect to the core element, a retaining groove formed in an outer surface of the core element and a retaining clip positioned in the groove and containing the movable collar on the core element.

16. The signal connection system of claim 10, wherein the push-on core and push-on bore form an electrical path that is independent of an interface between the movable collar and second bore.

17. A signal connection system, comprising:

a circuit board having a signal conduction path and a ground path;

a male connector portion mounted on the circuit board, the male connector portion including:

a push-on bore including a center conductor pin coaxially mounted in the push-on bore, the center conductor pin coupled with a signal conduction path of the circuit board;

a second bore configured forwardly of the push-on bore, said second bore being of a larger diameter than the push-on bore;

a latch track positioned in the second bore and forming a plurality of inclined latch surfaces ending in respective detents;

a coaxial cable having an inner and outer conductor;

a female connector portion terminating the coaxial cable, a female connector portion including:

push-on core including a socket coaxially mounted with respect to the push-on core, the socket coupled with the inner conductor of the coaxial cable;

the push-on bore configured to receive the push-on core so the center conductor pin is received in the socket;

a movable collar mounted rearwardly of the push-on core and including a plurality of bayonet pins mounted thereon, the movable collar configured for engaging the second bore when the push-on bore receives the push-on core and being rotatable and axially slidable with respect to the push-on core when engaging the second bore;

the bayonet pins sliding along the inclined latch surfaces when the collar is rotated to axially drive the movable collar into the second bore and secure the female push-on core into the male push-on bore, the bayonet pins resting in the detents to lock the movable collar in the second bore;

a resilient member coupled between the movable collar and push-on core, the resilient member biasing the push-on core into the push-on bore when the movable collar is axially driven into the second bore.

18. The signal connection system of claim 17, wherein the said second bore has a larger diameter than the male push-on bore.

19. The signal connection system of claim 17, wherein the latch track is positioned in the second bore to form blind latch tracks.

20. The signal connection system of claim 19, wherein the push-on core and push-on bore form an electrical path that is independent of an interface between the movable collar and second bore.

21. The signal connection system of claim 17, wherein the resilient member is a coil spring.

22. The signal connection system of claim 17, wherein the female connector portion further includes a core element including the push-on core, the core element including a flange thereon, the movable collar including a shelf, the resilient member captured between the movable collar shelf and core element flange for biasing the core element and push-on core when the movable collar is axially driven into the second bore.

23. The signal connection system of claim 17, wherein the female connector portion further includes a core element including the push-on core, the movable collar being rotatable and axially slidable with respect to the core element, a retaining groove formed in an outer surface of the core element and a retaining clip positioned in the groove and containing the movable collar on the core element.

24. A method for transferring an electrical signal from one component to another component comprising:

inserting a female push-on core including a socket into male push-on bore including a center conductor pin to mate the push-on core and push on bore, the center conductor pin engaging the socket for passing signals therebetween;

sliding a movable collar mounted rearwardly of the female push-on core toward the mated push-on core and push-on bore, the movable collar including a plurality of bayonet pins mounted thereon;

engaging a second bore positioned forwardly of the push-on bore with the movable collar, the second bore including a latch track forming a plurality of inclined latch surfaces ending in respective detents;

engaging the latch surfaces with the bayonet pins;

rotating the movable collar and moving the bayonet pins along the latch surfaces toward respective detents to lock the collar in the second bore;

biasing the movable collar away from the female push-on core so that the female push-on core is biased into the male push-on bore when the movable collar locked in the second bore.

25. The method of claim 24, wherein the latch track forms a blind latch track in the second bore.

26. The method of claim 24 further comprising biasing the movable collar with a coil spring.

27. The method of claim 24 further wherein the female push-on core is part of a core element, the core element including a flange thereon, the movable collar including a shelf, and further comprising capturing a resilient member between the movable collar shelf and core element flange for biasing the core element with respect to the female push-on core.

* * * * *